US007894577B2

(12) United States Patent
Teague

(10) Patent No.: US 7,894,577 B2
(45) Date of Patent: Feb. 22, 2011

(54) METHOD FOR DOWNHOLE, NON-ISOTOPIC GENERATION OF IONISED RADIATION AND AN APPARATUS FOR USE WHEN PRACTISING THE METHOD

(75) Inventor: Phil Teague, Stavanger (NO)

(73) Assignee: Visuray AS (NO)

( * ) Notice: Subject to any disclaimer, the term of this patent is extended or adjusted under 35 U.S.C. 154(b) by 92 days.

(21) Appl. No.: 12/515,453

(22) PCT Filed: Nov. 19, 2007

(86) PCT No.: PCT/NO2007/000406

§ 371 (c)(1),
(2), (4) Date: May 28, 2009

(87) PCT Pub. No.: WO2008/069674

PCT Pub. Date: Jun. 12, 2008

(65) Prior Publication Data

US 2010/0051796 A1 Mar. 4, 2010

(30) Foreign Application Priority Data

Nov. 20, 2006 (NO) ..... 20065324

(51) Int. Cl.
*H05J 35/00* (2006.01)

(52) U.S. Cl. ..... 378/119; 378/1; 250/253

(58) Field of Classification Search ..... 378/1, 378/57–60, 119; 250/253
See application file for complete search history.

(56) References Cited

U.S. PATENT DOCUMENTS 5,736,636 A 4/1998 Mozelev et al. ..... 73/152.05
5,789,876 A 8/1998 Umstadter et al. ..... 315/507
6,724,782 B2 4/2004 Hartemann et al. ..... 372/5

FOREIGN PATENT DOCUMENTS

WO WO 2005/022133 A1 3/2005

OTHER PUBLICATIONS

International Search Report dated Mar. 12, 2008, issued in corresponding international application No. PCT/N02007/000406.

*Primary Examiner*—Courtney Thomas
(74) *Attorney, Agent, or Firm*—Ostrolenk Faber LLP

(57) ABSTRACT

A method and apparatus for downhole generation of non-radioactive, ionized radiation arranged so as to be able to generate reverberation, particularly X-ray and/or gamma radiation, from the surroundings of a borehole, wherein the method includes the steps of: exciting laser light in a multi-stage laser light booster by means of a pump-type laser light source so as to form a pulsed laser light, the incoming light energy being concentrated in restricted laser light pulses representing a higher amount of light energy than that of a continuous flux of laser light; forming a concentration of dissociated electrons in a vacuum chamber; focusing the pulsed laser light at a point in the concentration of dissociated electrons so as to form a field (wakefield) of pulsed electrons which, upon generation of Bremsstrahlung, emit ionized radiation to the surroundings, thereby forming a high-energy reverberation in the gamma and/or X-ray frequency range from the surroundings.

11 Claims, 3 Drawing Sheets

METHOD FOR DOWNHOLE, NON-ISOTOPIC GENERATION OF IONISED RADIATION AND AN APPARATUS FOR USE WHEN PRACTISING THE METHOD

CROSS REFERENCE TO RELATED APPLICATIONS

The present application is a 35 U.S.C. §371 National Phase conversion of PCT/NO2007/000406, filed Nov. 19, 2007, which claims benefit of Norwegian Application No. 20065324, filed Nov. 20, 2006, the disclosure of which is incorporated herein by reference. The PCT International Application was published in the English language.

BACKGROUND OF THE INVENTION

The invention concerns a method for downhole, non-isotopic generation of ionised radiation, particularly in exploration- and production wells for oil, gas and water. The invention also concerns an apparatus for use when practising the method.

According to prior art, when carrying out downhole logging and gathering of material data, radioactive isotopes are used extensively. The disadvantages of this technique include the radiation danger caused by radioactive isotopes and, as a consequence, costly and demanding handling of isotopes and radioactive waste both at the installations where the drilling is carried out, and at the associated supply- and is service facilities.

SUMMARY OF THE INVENTION

The object of the invention is to remedy or to reduce at least one of the disadvantages of the prior art.

The object is achieved by virtue of features disclosed in the following description and in the subsequent claims.

The object of the invention is to provide a method for non-isotopic generation of ionised radiation and an apparatus for use when practising the method.

The object of the invention is achieved by virtue of a method in which ionised radiation are provided in a non-radioactive manner by subjecting a cloud of dissociated electrons to a pulsed laser light. Consequently, the output power of such a manner of providing ionised radiation is many times greater than that experienced when using radioactive isotopes, which results in a strong reduction in the time consumed for logging a particular amount of data, which in turn results in a cost reduction. The method does not involve use of radioactive isotopes, thus eliminating the extensive checks, safety measures etc. used when handling radioactive isotopes and radioactive waste materials.

The apparatus used for practising the method of the invention exhibits a combination of known and new techniques within the fields of electronics, optoelectronics and physics.

The ability to provide high-intensive ionised radiation when required down in a borehole, and without having to use radioactive materials, will prove very advantageous within the oil- and gas industry when logging is to be carried out, for example of a subsurface structure.

In a first aspect, the invention concerns particularly a method for downhole generation of non-radioactive, ionised radiation arranged so as to be able to generate reverberation, particularly X-ray- and/or gamma radiation, from the surroundings of a borehole, characterized in that the method comprises the steps of:

- forming a laser light;
- directing the laser light into a multistage laser light booster;
- exciting the laser light by means of a pump-type laser light source so as to form a pulsed laser light, the incoming light energy being concentrated in restricted laser light pulses representing a higher amount of light energy than that of the continuous flux of laser light;
- forming a concentration of dissociated electrons in a vacuum chamber;
- focussing the pulsed laser light at a point in the concentration of dissociated electrons so as to form a field (wake-field) of pulsed electrons which, upon generation of Bremsstrahlung, emit ionised radiation to the surroundings,
- thereby forming a high-energy reverberation in the gamma- and/or X-ray frequency range from the surroundings.

Preferably, the pulsed laser light exhibits a frequency in the femtosecond range.

Advantageously, the concentration of dissociated electrons forms an electron cloud between a warm cathode and an anode. Alternatively, the concentration of dissociated electrons is formed upon heating a solid until formation of dense plasma.

Preferably, the solid is heated by focussing the pulsed laser light in immediate vicinity of the surface of the solid.

In a second aspect, the invention concerns particularly an apparatus for downhole generation of non-radioactive, ionised radiation arranged so as to be able to generate reverberation, particularly X-ray- and/or gamma radiation, from the surroundings of a borehole, characterized in that the apparatus comprises:

- a laser light source;
- a multistage booster;
- a pulse-type laser light source connected to the booster and collectively being arranged so as to be able to form a pulsed laser light, the energy of the restricted laser light pulses representing a higher amount of light energy than that of a continuous flux of laser light formed by the laser light source;
- a vacuum chamber comprising one or several means arranged so as to be able to form a concentration of dissociated electrons;
- means arranged so as to be able to direct the laser light from the laser light source to the vacuum chamber via the booster;
- means arranged so as to be able to focus the pulsed laser light at a point in the concentration of dissociated electrons; and
- means arranged so as to be able to emit ionised radiation to the surroundings encircling the apparatus, the ionised radiation being formed upon generation of Bremsstrahlung in the concentration of dissociated electrons.

Preferably, the pulse-type laser light source is arranged so as to be able to form the pulsed laser light at a frequency in the femtosecond range ($10^{-15}$ sec).

Advantageously, the means arranged so as to be able to direct the laser light is comprised of a plurality of mirrors. Alternatively, the means is comprised of fibre-optics.

Advantageously, the means arranged so as to be able to focus the pulsed laser light at a point in the concentration of dissociated electrons is a concave mirror. Alternatively, the means is comprised of a lens arrangement.

An example of a preferred embodiment is described in the following and is depicted in the accompanying drawings, in which:

DESCRIPTION OF PREFERRED EMBODIMENTS

Figure 1:
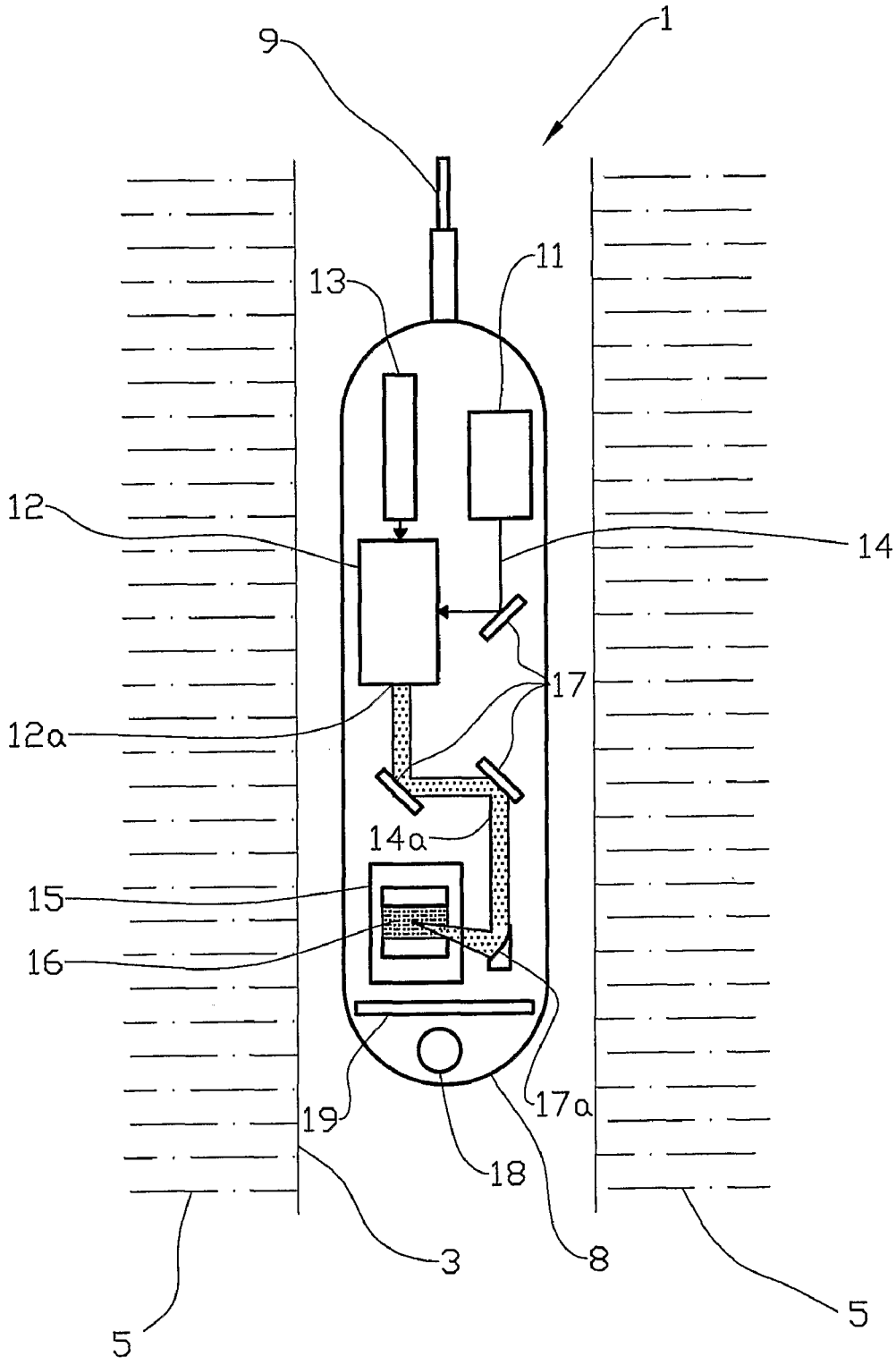
FIG. 1 shows an apparatus according to the invention placed in a borehole.

Reference is first made to FIG. 1 in which an apparatus according to the invention, as denoted with the reference numeral 1, is placed in a borehole 3 in a subsurface structure 5.

The apparatus 1 is provided with an outer jacket 8 connected to a device known per se (not shown) for positioning and displacement of the apparatus in the borehole 3 via a cable 9.

The apparatus 1 is provided with a laser light source 11 arranged so as to be able to provide a light ray 14, a multistage laser light booster 12, a pump-type laser light source 13 which is arranged, in cooperation with the laser light booster 12, to boost the light ray 14 and to provide a pulsed laser light 14*a*, which has a frequency in the femtosecond range, from the output 12*a* of the laser light booster 12. The apparatus 1 is further provided with a vacuum chamber 15 arranged so as to be able to form a concentration 16 of dissociated electrons, also termed an electron cloud. Several mirrors 17 are provided in a manner in which they are arranged so as to be able to direct the laser light 14, 14*a* from the laser light source 11 to the laser light booster 12, and from the laser light booster 12 to a means 17*a*, for example a concave mirror as shown herein, in order to focus the pulsed laser light 14*a* at a point in the electron cloud 16.

The apparatus 1 further comprises a detector 18 which is arranged, in a manner known per se, so as to be able to detect ionised radiation from the surroundings, more specifically from the subsurface structure 5 subject to logging. By means of a shield 19, the detector 18 is protected against the influence of direct ionised radiation from the radiation source of the apparatus 1, the radiation source being the electron cloud 16.

The apparatus 1 also comprises signal-communicating means (not shown) for signal transmission between the active units 11, 12, 13, 15, 18 in the apparatus 1, or between one or several of said units and control- and registration units (not shown) on the surface. These means may be comprised of wires, but it is obvious to a person skilled in the area that wireless transmission also may be suitable.

Figure 2:
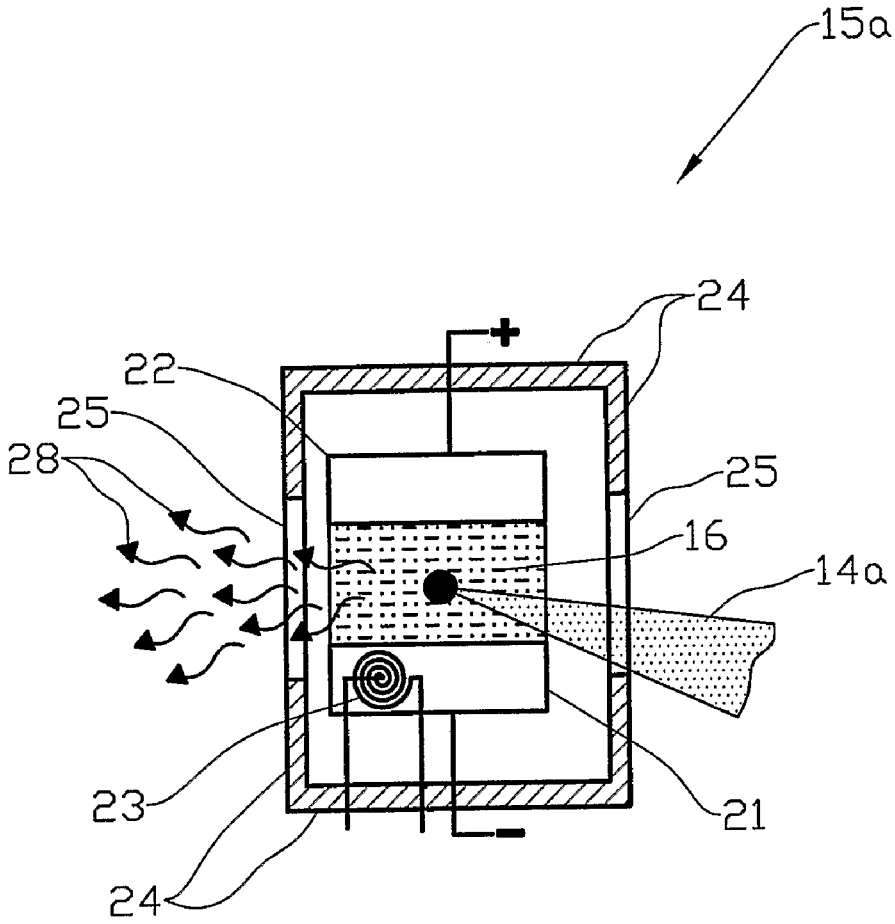
FIG. 2 shows, in larger scale, a vacuum chamber having an electron cloud formed between a warm cathode and an anode, and in accordance with a first embodiment example of the apparatus according to the invention.

Reference is now made to FIG. 2, in which a more detailed presentation shows a first embodiment example 15*a* of the vacuum chamber. A warm cathode 21 and an anode 22 are connected to a voltage source (not shown) in order to be able to establish and maintain, in a manner known per se, a voltage potential between the cathode 21 and the anode 22. The cathode 21 is provided with a heating element 23 connected to an energy source (not shown), for example an electricity supply. In a manner known per se, the vacuum chamber 15 is arranged to maintain an internally specified, suitable negative pressure, the walls 24 of the vacuum chamber 15 being joined in a pressure-sealing manner, and the required fluid-conduit-conveying conduit bushings for cathode 21, anode 22 and heating element 23 being pressure-sealing. The vacuum chamber 15 comprises windows 25 permeable to radiation in the form of pulsed laser light 14*a* and ionised radiation 28.

Upon heating the cathode 21 and applying the voltage potential between the cathode 21 and the anode 22, an electron cloud 16 is formed in the vacuum chamber 15*a* by virtue of the warm cathode 21 emitting electrons through thermal emission from the cathode material, and the emitted electrons are attracted to the positively charged anode 22.

Figure 3:
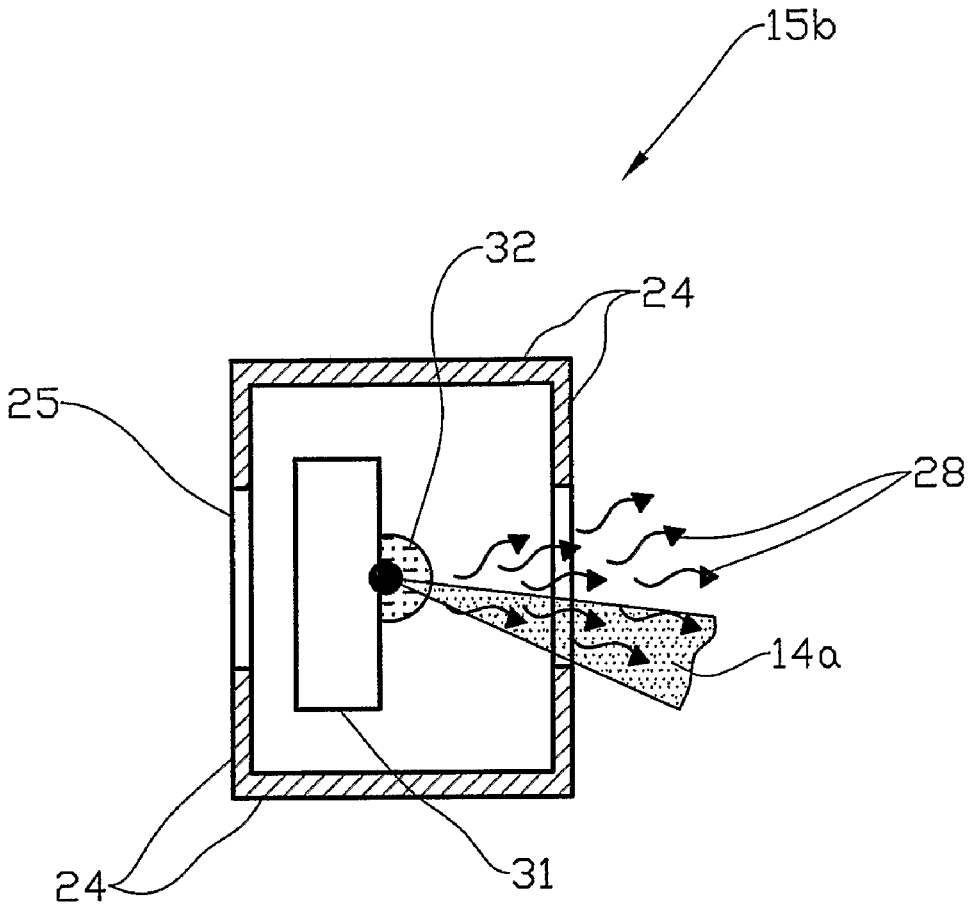
FIG. 3 shows, in larger scale, a vacuum chamber having an electron cloud formed of superheated plasma from a solid, and in accordance with a second embodiment example of the apparatus according to the invention.

Reference is now made to FIG. 3, in which a detailed presentation shows a second embodiment example 15*b* of the vacuum chamber. This embodiment exhibit the same type of pressure sealing and windows as described hereinbefore. A solid 31 is placed within the vacuum chamber 15*b*. Upon superheating by means of the focussed laser light 14*a*, it is possible to form plasma 32 having dissociated electrons corresponding to the electron cloud 16 mentioned above.

When illuminating the electron cloud 16 with the laser light 14*a*, the electrons will be forced aside in the same manner in which water is forced aside when a ship moves in the water. When a light pulse has passed, the electrons will move back, and what is termed a "wakefield" in English is formed. In a manner known per se, this steadily forced-on electron motion in the region around the laser light ray 14*a* generates Bremsstrahlung, which in turn induces ionised radiation 28. This ionised radiation 28 is directed toward the surroundings, i.e. the surrounding subsurface structure 5 of the borehole 3, generating reverberation in the form of X-ray- and gamma radiation, which may be detected by the detector 18.

When using the second embodiment example of the invention, the pulsed laser light 14*a* is focussed at the solid 31, the illuminated region developing strong heat forming dense plasma 32 of dissociated electrons. In the same manner as described above for the electron cloud 16, the pulsating laser light 14*a* generates ionised radiation 28.

Thus, in order to allow the subsurface structure 5 and the fluids contained therein to be mapped, the detected reverberation undergoes registering, storage and analysis in a normal manner.

It will be obvious to a person skilled in the area that the present method and apparatus for providing ionised radiation in accordance with the invention, is not limited only to logging operations, but to a number of areas having confined space and limited possibilities for supply of energy.

It is also obvious to a skilled person that the present invention provides desired radiation intensity in a quick and risk-free manner. This allows a prescribed investigation to be carried out in a shorter time than that of using conventional, isotope-based methods. This, among other things, is because the radiation intensity may be increased without any risk to the surroundings, insofar as no radioactive isotopes are present requiring handling both before and after having carried out investigations of the types discussed herein.

What is claimed is:

1. A method for downhole generation of non-radioactive, ionised radiation arranged so as to be able to generate reverberation, particularly X-ray- and/or gamma radiation, from the surroundings of a borehole, wherein the method comprises the steps of:

forming a laser light;

directing the laser light into a multistage laser light booster;

exciting the laser light by means of a pump-type laser light source so as to form a pulsed laser light, the incoming light energy being concentrated in restricted laser light pulses representing a higher amount of light energy than that of the continuous flux of laser light;

forming a concentration of dissociated electrons in a vacuum chamber;

focussing the pulsed laser light at a point in the concentration of dissociated electrons so as to form a field (wakefield) of pulsed electrons which, upon generation of Bremsstrahlung, emit ionised radiation to the surroundings, thereby forming a high-energy reverberation in the gamma- and/or X-ray frequency range from the surroundings.

2. The method according to claim 1, wherein the pulsed laser light exhibits a frequency in the femtosecond range.

3. The method according to claim 1, wherein the concentration of dissociated electrons forms an electron cloud between a warm cathode and an anode.

4. The method according to claim 1, wherein the concentration of dissociated electrons is formed upon heating a solid until formation of dense plasma.

5. The method according to claim 4, wherein the solid is heated by focussing the pulsed laser light in immediate vicinity of the surface of the solid.

6. An apparatus for downhole generation of non-radioactive, ionised radiation arranged so as to be able to generate reverberation, particularly X-ray- and/or gamma radiation, from the surroundings of a borehole, wherein the apparatus comprises:

a laser light source;

a multistage booster;

a pulse-type laser light source connected to the booster and collectively being arranged so as to be able to form a pulsed laser light, the energy of the restricted laser light pulses representing a higher amount of light energy than that of a continuous flux of laser light formed by the laser light source;

a vacuum chamber comprising one or several means arranged so as to be able to form a concentration of dissociated electrons;

means arranged so as to be able to direct the laser light from the laser light source to the vacuum chamber via the booster;

means arranged so as to be able to focus the pulsed laser light at a point in the concentration of dissociated electrons; and means arranged so as to be able to emit ionised radiation to the surroundings encircling the apparatus, the ionised radiation being formed upon generation of Bremsstrahlung in the concentration of dissociated electrons.

7. The apparatus according to claim 6, wherein the pulse-type laser light source is arranged so as to be able to form the pulsed laser light at a frequency in the femtosecond range ($10^{-15}$ sec).

8. The apparatus according to claim 6, wherein the means arranged so as to be able to direct the laser light is comprised of a plurality of mirrors.

9. The apparatus according to claim 6, wherein the means arranged so as to be able to direct the laser light is comprised of fibre-optics.

10. The apparatus according to claim 6, wherein the means arranged so as to be able to focus the pulsed laser light at a point in the concentration of dissociated electrons is a concave mirror.

11. The apparatus according to claim 6, wherein the means arranged so as to be able to focus the pulsed laser light at a point in the concentration of dissociated electrons is a lens arrangement.

* * * * *